US009318127B2

(12) United States Patent
Disch et al.

(10) Patent No.: US 9,318,127 B2
(45) Date of Patent: Apr. 19, 2016

(54) DEVICE AND METHOD FOR IMPROVED MAGNITUDE RESPONSE AND TEMPORAL ALIGNMENT IN A PHASE VOCODER BASED BANDWIDTH EXTENSION METHOD FOR AUDIO SIGNALS

(75) Inventors: Sascha Disch, Fuerth (DE); Frederik Nagel, Nuremberg (DE); Stephan Wilde, Wendelstein (DE); Lars Villemoes, Jaerfaella (SE); Per Ekstrand, Saltsiobaden (SE)

(73) Assignees: Fraunhofer-Gesellschaft zur Foerderung der angewandten Forschung e.V., Munich (DE); Dolby International AB, Amsterdam Zuid-Oost (NL)

( * ) Notice: Subject to any disclaimer, the term of this patent is extended or adjusted under 35 U.S.C. 154(b) by 712 days.

(21) Appl. No.: 13/604,313

(22) Filed: Sep. 5, 2012

(65) Prior Publication Data

US 2013/0058498 A1 Mar. 7, 2013

Related U.S. Application Data

(63) Continuation of application No. PCT/EP2011/053298, filed on Mar. 4, 2011.

(60) Provisional application No. 61/312,118, filed on Mar. 9, 2010.

(51) Int. Cl.
*G10L 21/038* (2013.01)

(52) U.S. Cl.
CPC ..... *G10L 21/038* (2013.01)

(58) Field of Classification Search
CPC ..... G10L 19/008; G10L 21/038; G10L 25/18
USPC ..... 704/200–201, 500–501
See application file for complete search history.

(56) References Cited

U.S. PATENT DOCUMENTS

| | | | | |
|---|---|---|---|---|
| 5,455,888 | A | 10/1995 | Iyengar et al. | |
| 6,549,884 | B1 * | 4/2003 | Laroche et al. | 704/207 |
| 6,766,300 | B1 | 7/2004 | Laroche | |

(Continued)

FOREIGN PATENT DOCUMENTS

| | | |
|---|---|---|
| CN | 1511312 | 7/2004 |
| CN | 101471072 | 7/2009 |

(Continued)

OTHER PUBLICATIONS

Geiser, et al., "Bandwidth Extension for Hierarchical Speech and Audio Coding in ITU-T Tec. G.729.1", IEEE Transactions on Audio, Speech, and Language Processing, vol. 15, No. 8, Nov. 2007.

(Continued)

*Primary Examiner* — Douglas Godbold
(74) *Attorney, Agent, or Firm* — Michael A. Glenn; Perkins Coie LLP

(57) ABSTRACT

An apparatus for generating a bandwidth extended audio signal from an input signal, includes a patch generator for generating one or more patch signals from the input signal, wherein the patch generator is configured for performing a time stretching of subband signals from an analysis filterbank, and wherein the patch generator further includes a phase adjuster for adjusting phases of the subband signals using a filterbank-channel dependent phase correction.

25 Claims, 12 Drawing Sheets

(56) References Cited

U.S. PATENT DOCUMENTS

| | | | | |
|---|---|---|---|---|
| 6,895,375 | B2 | 5/2005 | Malah et al. | |
| 7,337,108 | B2 | 2/2008 | Florencio et al. | |
| 7,917,360 | B2 | 3/2011 | Rogers | |
| 8,296,159 | B2 | 10/2012 | Neuendorf | |
| 2003/0187663 | A1 | 10/2003 | Truman et al. | |
| 2004/0125878 | A1* | 7/2004 | Liljeryd et al. | 375/242 |
| 2004/0176961 | A1 | 9/2004 | Manu et al. | |
| 2006/0239473 | A1 | 10/2006 | Kjorling et al. | |
| 2007/0071116 | A1 | 3/2007 | Oshikiri et al. | |
| 2007/0078650 | A1 | 4/2007 | Rogers et al. | |
| 2007/0285815 | A1* | 12/2007 | Herre et al. | 360/13 |
| 2008/0222228 | A1 | 9/2008 | Halle | |
| 2009/0063140 | A1 | 3/2009 | Villemoes et al. | |
| 2009/0234646 | A1 | 9/2009 | Kjorling et al. | |
| 2009/0276069 | A1 | 11/2009 | Rogers | |
| 2010/0003543 | A1 | 1/2010 | Zhou | |
| 2010/0085102 | A1* | 4/2010 | Lee et al. | 327/334 |
| 2010/0114583 | A1* | 5/2010 | Lee et al. | 704/500 |
| 2011/0004479 | A1* | 1/2011 | Ekstrand et al. | 704/500 |
| 2011/0054885 | A1 | 3/2011 | Nagel et al. | |
| 2011/0208517 | A1 | 8/2011 | Zopf | |
| 2012/0195442 | A1* | 8/2012 | Villemoes et al. | 381/98 |

FOREIGN PATENT DOCUMENTS

| | | |
|---|---|---|
| EP | 1940023 | 7/2008 |
| EP | 2214165 | 4/2010 |
| JP | S55-107313 | 8/1980 |
| JP | 2001-521648 | 11/2001 |
| JP | 2004-053895 | 2/2004 |
| JP | 2004-053940 | 2/2004 |
| JP | 2004-206129 | 7/2004 |
| JP | 2005-128387 | 5/2005 |
| JP | 2005-521907 | 7/2005 |
| JP | 2007-017628 | 1/2007 |
| JP | 2007-101871 | 4/2007 |
| JP | 2009-519491 | 5/2009 |
| TW | 200939211 | 9/2009 |
| TW | 201007701 | 2/2010 |
| WO | WO-9857436 | 12/1998 |
| WO | WO-02084645 | 10/2002 |
| WO | WO-2005040749 | 5/2005 |
| WO | WO-2009078681 | 6/2009 |
| WO | WO-2009/095169 | 8/2009 |
| WO | WO-2009112141 | 9/2009 |
| WO | WO-2010003557 | 1/2010 |
| WO | WO-2010069885 | 6/2010 |
| WO | WO-2010086461 | 8/2010 |

OTHER PUBLICATIONS

"ISO/IEC 14496-3, 4.6.18.4.2", Synthesis Filterbank, pp. 220-221, 2005.

"ISO/IEC 14496-3: 2005 ( E ) section 4.6.8", Joint Coding, pp. 150-157, 2005.

Aarts, R et al., "A Unified Approach to Low- and High Frequency Bandwidth Extension", In AES 115th Convention. New York, New York, USA, pp. 1-16, Oct. 2003.

Arora, M et al., "High Quality Blind Bandwidth Extension of Audio for Portable Player Applications", Presented at the 120th AES Convention. Paris, France, pp. 1-6, May 20, 2006.

Dietz, M et al., "Spectral Band Replication, a Novel Approach in Audio Coding", Presented at the 112th AES Convention. Munich, Germany, pp. 1-8, May 10, 2002.

Duxbury, C et al., "Separation of Transient Information in Musical Audio Using Multiresolution Analysis Techniques", Proceedings of the COST G-6 Conference on Digital Audio Effects (DAFX-01). Limerick, Ireland, pp. 1-4, Dec. 6, 2001.

Fielder, L et al., "Introduction to Dolby Digital Plus, an Enhancement to the Dolby Digital Coding System", Presented at the 117the Convention. San Francisco, CA, USA., pp. 1-29, Oct. 28, 2004.

Henn, F et al., "Spectral Band Replications (SBR) Technology and its Application in Broadcasting", 112th AES Convention. Munich, Germany, pp. 423-430, 2003.

Herre, J et al., "MP3 Surround: Efficient and Compatible Coding of Multi-Channel Audio", Presented at the 116th Conv. Aud. Eng. Soc. Berlin, Germany., 14 Pages, May 8, 2004.

Hsu, H et al., "Audio Patch Method in MPEG-4 HE-AAC Decoder", Presented at the 117th AES Convention. San Francisco, CA, USA., pp. 1-11, Oct. 28, 2004.

Huan, Zhou et al., "Core Experiment on the eSBR module of USAC", 90. MPEG Meeting; Oct. 26-30, 2009; Xian; (Motion Picture Expert Group of ISO/IECT JTC1/SC29/WG11); Oct. 23, 2009.

Iyengar, V et al., "International Standard ISO/IEC 14496-3:2001/FPDAM 1: Bandwidth Extension", Speech Bandwidth Extension Method and Apparatus, 405 pages, Oct. 2002.

Kayhko, "A Robust Wideband Enhancement for Narrowband Speech Signal", Research Report, Helsinki Univ. of Technology, Laboratory of Acoustics and Audio Signal Processing, 75 pages, 2001, cited in Kallio, Laura "Artificial Bandwidth Expansion of Narrowband Speech in Mobile Communication Systems", Master's Thesis, Helsinki University, p. 65, Dec. 9, 2002.

Larsen, E et al., "Audio Bandwidth Extension—Application to Psychoacoustics, Signal Processing and Loudspeaker Design", John Wiley & Sons, Ltd., 33 Pages, 2004.

Larsen, E et al., "Efficient High-Frequency Bandwidth Extension of Music and Speech", In AES 112th Convention. Munich, Germany, pp. 1-5 May 2002.

Makhoul, J et al., "Spectral Analysis of Speech by Linear Prediction", IEEE Transactions on Audio and Electroacoustics. vol. AU-21, No. 3., Jun. 1973, 140-148.

Meltzer, S et al., "SBR enhanced audio codecs for digital broadcasting such as "Digital Radio Mondiale" (DRM)", AES 112th Convention. Munich, Germany, 4 Pages, May 2002.

Neuendorf, M et al., "A Novel Scheme for Low Bitrate Unified Speech and Audio Coding", Presented at the 126th AES Convention. München, Germany, pp. 1-13, May 2009.

Neuendorf, M et al., "Unified Speech and Audio Coding Scheme for High Quality at Lowbitrates", ICASSP, pp. 1-4, 2009.

Puckette, M et al., "Phase-locked Vocoder", IEEE ASSP Conference on Applications of Signal Processing to Audio and Acoustics. Mohonk, New York, USA., 4 Pages, 1995.

Ravelli, E et al., "Fast Implementation for Non-Linear Time-Scaling of Stereo Signals", Proc. of the 8th Int. Conference on Digital Audio Effects (DAFx'05). Madrid, Spain, pp. 1-4, Sep. 20, 2005.

Robel, A et al., "A New Approach to Transient Processing in the Phase Vocoder", Proc. of the 6th Int. Conference on Digital Audio Effects (DAFX-03). London, UK., pp. 1-6, Sep. 8, 2003.

Robel, A et al., "Transient Detection and Preservation in the Phase Vocoder", ICMC '03. Singapore. Link provided: citeseer.ist.psu.edu/679246.html, pp. 247-250 2003.

Zhong, Haishan et al., "Finalization of CE on QMF based harmonic transposer", 94. MPEG Meeting; Oct. 11, 2010-Oct. 15, 2010; Guangzhou; (Motion Picture Expert Group or ISO/IEC JTC1/SC29/WG11); Oct. 28, 2010.

Zhou, Huan et al., "Finalization of CE on QMF based harmonic transposer", 93. MPEG Meeting; Jul. 26-30, 2010; Geneva; (Motion Picture Expert Group of ISO/IEC JTC1/SC29/WG11), Jul. 22, 2010.

Ziegler, T et al., "Enhancing mp3 with SBR: Features and Capabilities of the new mp3PRO Algorithm", Presented in the 112th AES Convention. Munich, Germany, pp. 1-7, May 10, 2002.

Disch, S et al., "An Amplitude-and Frequency-Modulation Vocoder for Audio Signal", Proceedings of the 11th International Conference on Digital Audio Effects (DAFx-08). Espoo, Finland., Sep. 1, 2008, 1-7.

Flanagan, J et al., "Phase Vocoder", The Bell System Technical Journal, Nov. 1966, 1493-1509.

ISO/IEC 14496-3, "Information Technology—Coding of Audio-Visual Objects", ISO/IEC 14496-3, Information Technology—Coding of Audio-Visual Objects (Document broken into 7 parts for IDS upload).

Laroche, J et al., "Improved Phase Vocoder Timescale Modification of Audio", IEEE Trans. Speech and Audio Processing. vol. 7, No. 3., May 1999, 323-332.

(56) References Cited

OTHER PUBLICATIONS

Laroche, J et al., "New Phase-Vocoder Techniques for Pitch-Shifting, Harmonizing and Other Exotic Effects", Proc. IEEE Workshop on App. of Signal Proc. to Signal Proc. to Audio and Acous. New Paltz, New York, USA., Oct. 17, 1999, 91-94.
Nagel, F et al., "A Harmonic Bandwidth Extension Method for Audio Codecs", ICASSP International Conference on Acoustics, Speech and Signal Processing. IEEE CNF. Taipei, Taiwan, Apr. 2009, 145-148.
Nagel, F et al., "A Phase Vocoder Driven Bandwidth", 126th AES Convention. Munich, Germany., May 2009, 1-8.
"ISO/IEC JTC 1 Directives, 5th Edition, Version 3.0", Apr. 5, 2007; XP055182104 [retrieved on Apr. 10, 2015], 188 pages.
Audio Subgroup: "MPEG Audio CE methodology"; International Organization for Standardization, ISO/IEC JTC 1/SC 29/WG 11; Apr. 25, 2009, XP055182357 [retrieved on Apr. 13, 2015]; pp. 1-9.
HoDs: "MPEG 101"; International Organization for Standardization, ISO/IEC JTC 1/SC 29/WG 11; Jan. 31, 2005, XP055182379, [retrieved on Apr. 13, 2015]; 39 pages.
Webmaster: "Geneva Meeting—Document Register", 93; MPEG meeting; Jul. 26, 2010-Jul. 30, 2010; Geneva; (Motion Picture Expert Group or ISO/IEC JTC1/SC29/WG11), Jul. 29, 2010, XP055182371, [retrieved on Apr. 13, 2015]; 23 pages.
Webmaster: "Guangzhou Meeting—Document Register", 94. MPEG meeting; Oct. 11, 2010-Oct. 15, 2010; Guangzhou; (Motion Picture Expert Group or ISO/IEC JTC1/SC29/WG11), Jan. 15, 2011, XP055182374, [retrieved on Apr. 13, 2015]; 42 pages.

* cited by examiner

| FIG 11 | |
|---|---|
| FIG 11A | FIG 11B |

| FIG 11 | |
|---|---|
| FIG 11A | FIG 11B |

phase corrections for avoiding amplitude variations

- symmetric situation of analysis/ synthesis filterbank pair:

151 $$\Delta\Theta_n = \frac{\pi}{2}(T-1)(n+\frac{1}{2});$$

151a 151b

T: transposition factor
n: filterbank channel

- asymmetric distribution of phase twiddles:

$$\Delta\Theta_n = (1-T)(\Theta_n - \Psi_n);$$

$\Psi_n$: phase twiddles e.g. a 64 band QMF filterbank pair

152 $$\Delta\Theta_n = \frac{385}{128}\pi(T-1)(n+\frac{1}{2});$$

152a 152b (depends on channel and transpos. factor)

- specific application of phase twiddles:

153 $$\Delta\Theta_n = -\frac{385}{128}\pi(n+\frac{1}{2});$$

(depends on channel only)

→ analysis filterbank adds a phase of $\frac{385}{128}\pi(n+\frac{1}{2})$; compared to above case

FIG 12

Ω: filterbank-channel dependent phase correction
(T-1)·Φ(o): signal-dependent phase term
Φ(m): phase of the current sample
T: transposition factor synthSize: number of channels of synthesis bank k: subband index
l: sample index

```
L=2*synthSize;
for (k=0; k<L; k++) {
    for (l=0; l<2*L; l++) {
        MM.real[k][l]=cos(PI/(2*L)*(k+0.5)*(2*l-2*L));
        MM.imag[k][l]=sin(PI/(2*L)*(k+0.5)*(2*l-2*L));
    }
}
```

phase correction independent on transposition factor

FIG 14A analysis filterbank modulation matching with complex SBR filterbank in ISO/IEC 14496-3, section 4.6.18.4.2 ks: index of a starting channel

```
L=2*synthSize;
for (k=0; k<L; k++) {
    for (l=0; l<2*L; l++) {
        MM.real[k][l]=cos(PI/(2*L)*((k+0.5)*(2*l-L/64.0)-L/32.0*ks));
        MM.imag[k][l]=sin(PI/(2*L)*((k+0.5)*(2*l-L/64.0)-L/32.0*ks));
    }
}
```

transposition factor dependent phase correction

FIG 14B

DEVICE AND METHOD FOR IMPROVED MAGNITUDE RESPONSE AND TEMPORAL ALIGNMENT IN A PHASE VOCODER BASED BANDWIDTH EXTENSION METHOD FOR AUDIO SIGNALS

CROSS-REFERENCE TO RELATED APPLICATIONS

This application is a continuation of copending International Application No. PCT/EP2011/053298, filed Mar. 4, 2011, which is incorporated herein by reference in its entirety, and additionally claims priority from U.S. Application No. 61/312,118, filed Mar. 9, 2010, which is also incorporated herein by reference in its entirety.

BACKGROUND OF THE INVENTION

By means of phase vocoders [1-3] or other techniques for time or pitch modification algorithms such as Synchronized Overlap-Add (SOLA), audio signals can for example be modified with respect to the playback rate, whereas the original pitch is preserved. Moreover, these methods can be applied to carry out a transposition of the signal while maintaining the original playback duration. The latter can be accomplished by stretching the audio signal with an integer factor and subsequent adjustment of the playback rate of the stretched audio signal applying the same factor. For a time-discrete signal, the latter corresponds to a down sampling of the time stretched audio signal about the stretching factor given that the sampling rate remains unchanged.

Phase vocoder based bandwidth extension methods like [4-5] generate, in dependency of the necessitated overall bandwidth, a variable number of band limited sub bands (patches) which are summed up to form a sum signal which exhibits the necessitated overall bandwidth.

The temporal alignment of the single patches which result from the phase vocoder application turns out to be a specific challenge. In general, these patches have time delays of different durations. This is because the synthesis windows of the phase vocoders are arranged in fixed hop sizes which are dependent on the stretching factor, and therefore every individual patch has a delay of a predefined duration. This leads to a frequency selective time delay of the bandwidth extended sum signal. Since this frequency selective delay affects the vertical coherence properties of the overall signal it has a negative impact on the transient response of the bandwidth extension method.

Another challenge is presented by considering the individual patches, where a lack of cross frequency coherence has a negative impact of the magnitude response of the phase vocoder.

SUMMARY

According to an embodiment, an apparatus for generating a bandwidth extended audio signal from an input signal may have: a patch generator for generating one or more patch signals from the input signal, wherein a patch signal has a patch center frequency being different from a patch center frequency of a different patch or from a center frequency of the input audio signal, wherein the patch generator is configured for performing a time stretching of subband signals from an analysis filterbank, and wherein the patch generator includes a phase adjuster for adjusting phases of the subband signals using a filterbank-channel dependent phase correction.

According to another embodiment, a method of generating a bandwidth extended audio signal from an input signal may have the steps of: generating one or more patch signals from the input signal, wherein a patch signal has a patch center frequency being different from a patch center frequency of a different patch or from a center frequency of the input audio signal, wherein a time stretching of subband signals from an analysis filterbank is performed, and wherein phases of the subband signals are adjusted using a filterbank-channel dependent phase correction.

Another embodiment may have a computer program having a program code for performing, when running in a computer, the inventive method.

An apparatus for generating a bandwidth extended audio signal from an input signal comprises a patch generator for generating one or more patch signals from the input signal. The patch generator is configured for performing a time stretching of subband signals from an analysis filter bank and comprises a phase adjuster for adjusting phases of the subband signals using a filterbank-channel dependent phase correction.

A further advantage of the present invention is that negative impacts on magnitude responses normally introduced by phase vocoder-like structures for bandwidth extension or other structures for bandwidth extension are avoided.

A further advantage of the present invention is that an optimized magnitude response of the individual patches, which are, for example, created by means of phase vocoders or phase vocoder-like structures, is obtained. In a further embodiment, the temporal alignment of the individual patches can be addressed as well, but the phase correction within a patch, i.e. among the subband signals processed using one and the same transposition factor can be applied with or without the time correction which is valid for all subband signals within a patch as a whole.

An embodiment of the present invention is a novel method for the optimization of the magnitude response and temporal alignment of the single patches which are created by means of phase vocoders. This method basically consists of choices of phase corrections to the transposed subbands in a complex modulated filterbank implementation and of the introduction of additional time delays into the single patches which result from phase vocoders with different transposition factors. The time duration of the additional delay introduced to a specific patch is dependent from the applied transposition factor and can be determined theoretically. Alternatively, the delay is adjusted such that, applying a Dirac impulse input signal, the temporal center of gravity of the transposed Dirac impulse in every patch is aligned on the same temporal position in a spectrogram representation.

There are many methods that carry out transpositions of audio signals by a single transposition factor such as the phase vocoder. If several transposed signals have to be combined, one can correct the time delays between the different outputs. A correct vertical alignment between the patches is useful but not necessarily part of these algorithms. This is not harmful as long as no transients are considered. The problem of correct alignment of different patches is not addressed in state of the art literature.

Transposition of spectra by means of phase vocoders does not guarantee to preserve the vertical coherence of transients. Moreover, post echoes emerge in the high frequency bands due to the overlap add method utilized in the phase vocoder as well as the different time delays of the single patches which contribute to the sum signal. It is therefore desirable to align the patches in a way such that the bandwidth extension parametric post processing can exploit a better vertical alignment amongst the patches. The entire time span covering pre- and post-echo has thereby to be minimized.

A phase vocoder is typically implemented by multiplicative integer phase modification of subband samples in the domain of an analysis/synthesis pair of complex modulated filter banks. This procedure does not automatically guarantee the proper alignment of the phases of the resulting output contributions from each synthesis subband, and this leads to a non-flat magnitude response of the phase vocoder. This artifact results in a time-varying amplitude of a transposed slow sine sweep. In terms of audio quality for general audio, the drawback is a coloring of the output by modulation effects.

BRIEF DESCRIPTION OF THE DRAWINGS

Embodiments of the present invention will be detailed subsequently referring to the appended drawings, in which:

FIG. 12 illustrates different implementations for selecting the subband channel dependent phase correction;

FIG. 14*a* illustrates implementation details for an analysis filterbank allowing a transposition-factor independent phase correction; and FIG. 14*b* illustrates implementation details for an analysis filterbank necessitating a transposition-factor dependent phase correction.

DETAILED DESCRIPTION OF THE INVENTION

The present application provides different aspects of apparatuses, methods or computer programs for processing audio signals in the context of bandwidth extension and in the context of other audio applications, which are not related to bandwidth extension. The features of the subsequently described and claimed individual aspects can be partly or fully combined, but can also be used separately from each other, since the individual aspects already provide advantages with respect to perceptual quality, computational complexity and processor/memory resources when implemented in a computer system or micro processor.

Figure 1:
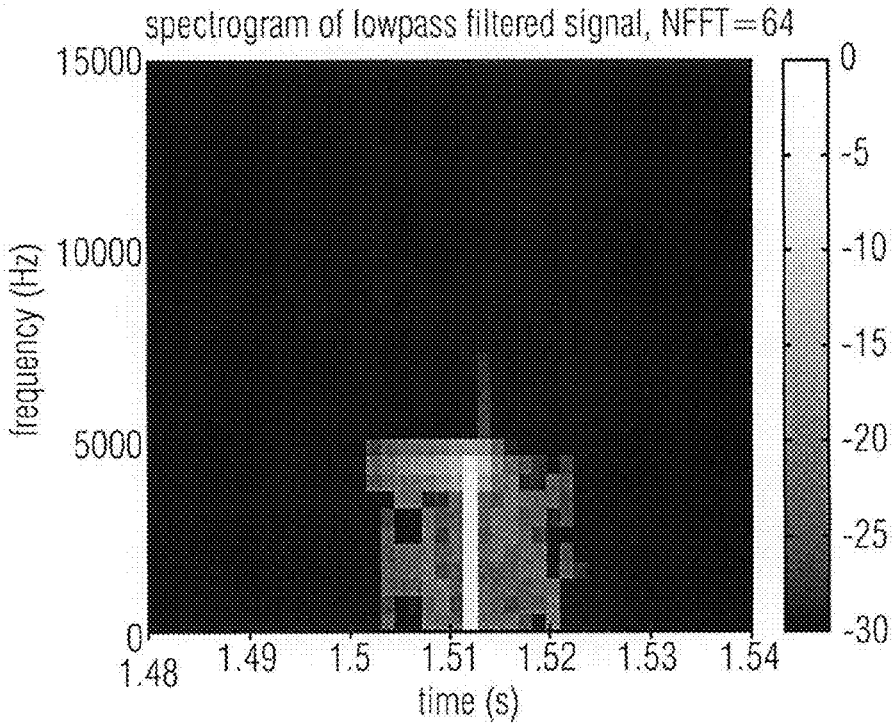
FIG. 1 illustrates a spectrogram of a lowpass filtered Dirac impulse.

Embodiments employ a time alignment of the different harmonic patches which are created by phase vocoders. The time alignment is carried out on the basis of the center of gravity of a transposed Dirac impulse. The subsequent FIG. 1 shows the spectrogram of a lowpass filtered Dirac impulse which therefore exhibits limited bandwidth. This signal serves as input signal for the transposition.

Figure 2:
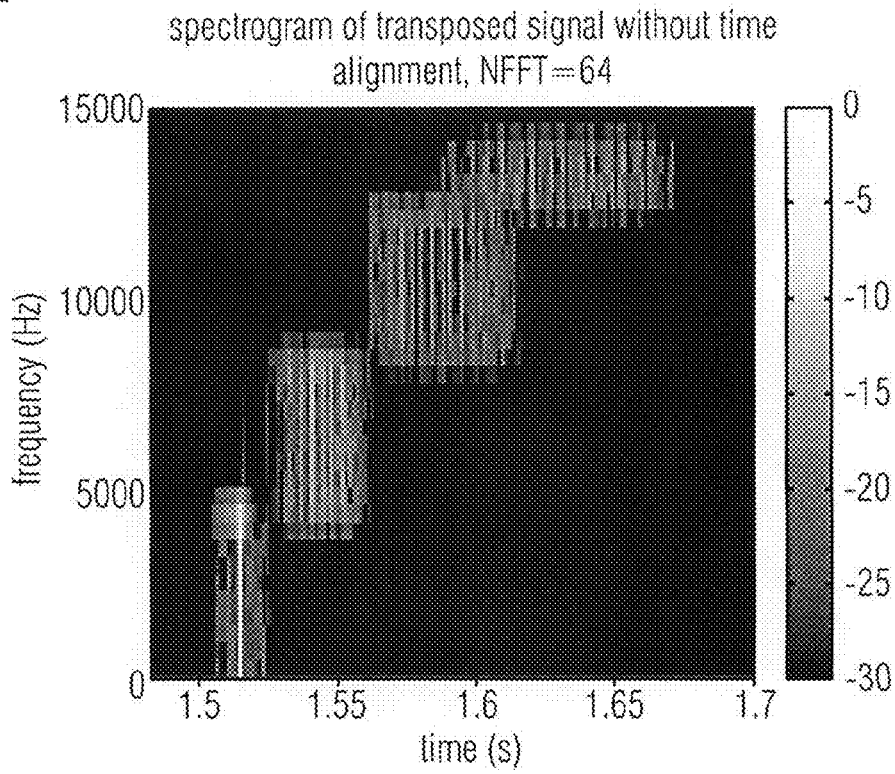
FIG. 2 illustrates a spectrogram of state of the art transposition of a Dirac impulse with the transposition factors 2, 3, and 4.

By transposing this Dirac impulse by means of a phase vocoder, frequency selective delays are introduced into the resulting sub bands. The time duration of these is dependent on the utilized transposition factor. Subsequently, the transposition of a Dirac impulse with the transposition factors 2, 3 and 4 is shown exemplarily in FIG. 2.

Figure 3:
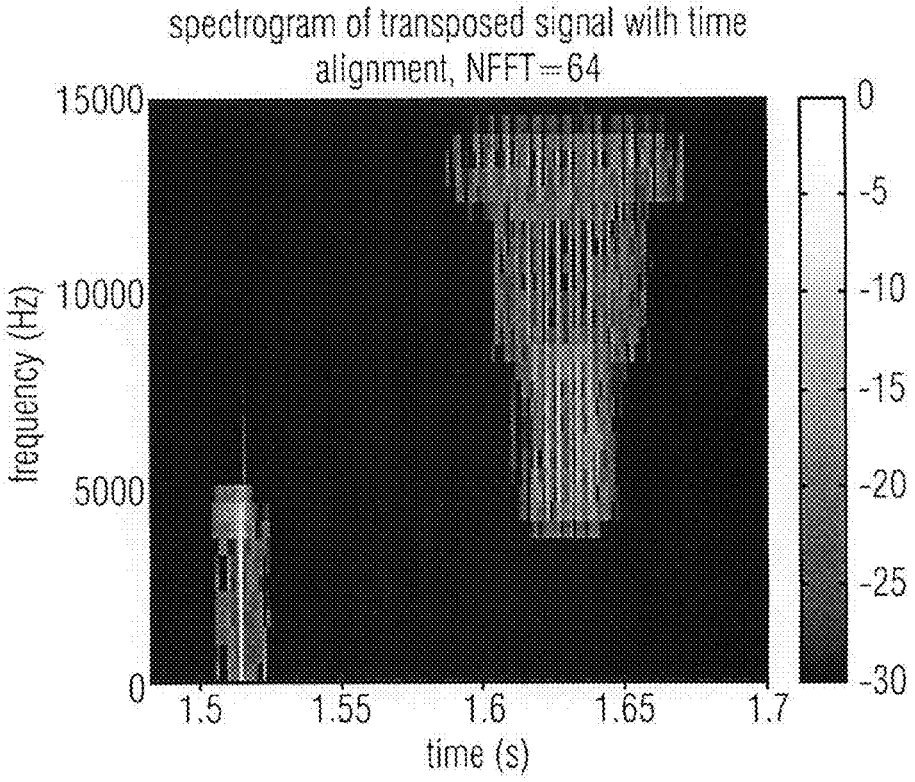
FIG. 3 illustrates a spectrogram of time aligned transposition or a Dirac impulse with the transposition factors 2, 3, and 4.

The frequency selective delays are compensated for by insertion of an additional individual time delay into each resulting patch. This way, every single sub band is aligned such, that the center of gravity of the Dirac impulse in every patch is located at the same temporal position as the center of gravity of the Dirac impulse in the highest patch. The alignment is carried out based on the highest patch because it usually owns the highest time delay. Applying the inventive delay compensation, the center of gravity of the Dirac impulse is located on the same temporal position for all patches inside a spectrogram. Such a representation of the resulting signals might look as depicted in FIG. 3. This leads to a minimization of the entire transient energy spread.

Figure 4:
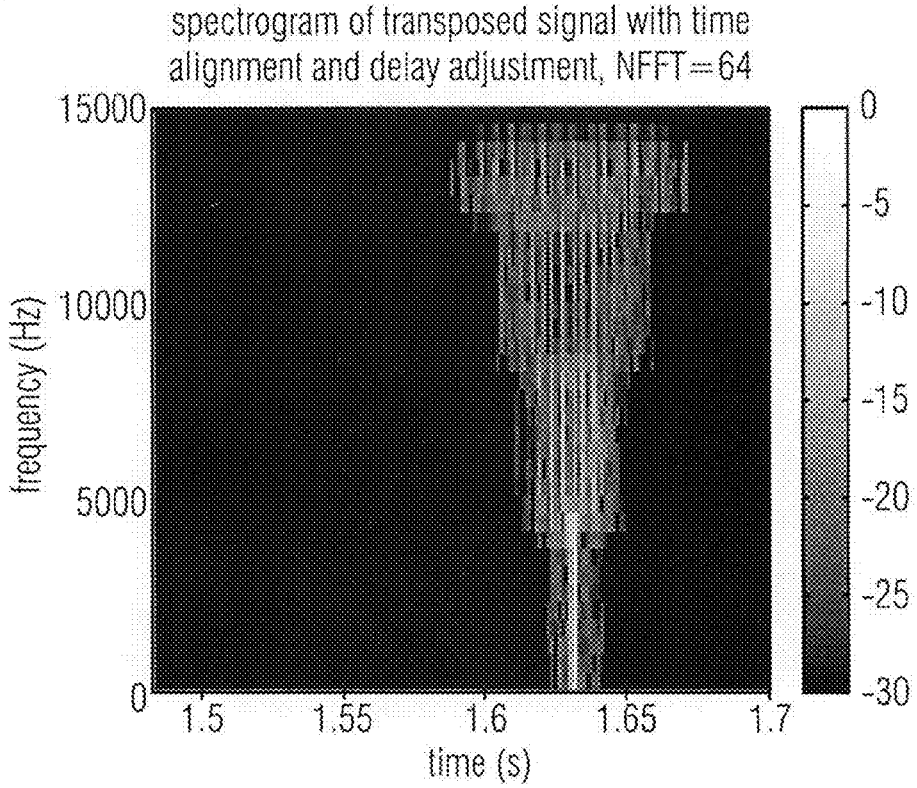
FIG. 4 illustrates a spectrogram of time aligned transposition of a Dirac impulse with the transposition factors 2, 3, and 4 and delay adjustment.

Eventually, it is necessitated to additional compensate for the remaining time delay between the transposed high frequency regions and the original input signal For that purpose, the input signal can be delayed as well so that the centers of gravity of the transposed Dirac impulses, which have been aligned to a certain temporal position beforehand, match the temporal position of the band limited Dirac impulse. Subsequently, the spectrogram of the resulting signal is shown in FIG. 4.

For the application of the described method it is insignificant whether the phase vocoder as fundamental component of the bandwidth extension method is realised in time domain or inside a filter bank representation like for example a pQMF filter bank.

Using SOLA techniques, the subjective audio quality of transients is impaired by echo effects due to the overlap add whereas the vertical coherence criterion is fulfilled at transients. Possible, slight deviations of the positions of the center of gravity in the single patches from the actual center of gravity in the highest patch lie in the range of the pre masking or post masking, respectively.

Figure 5:
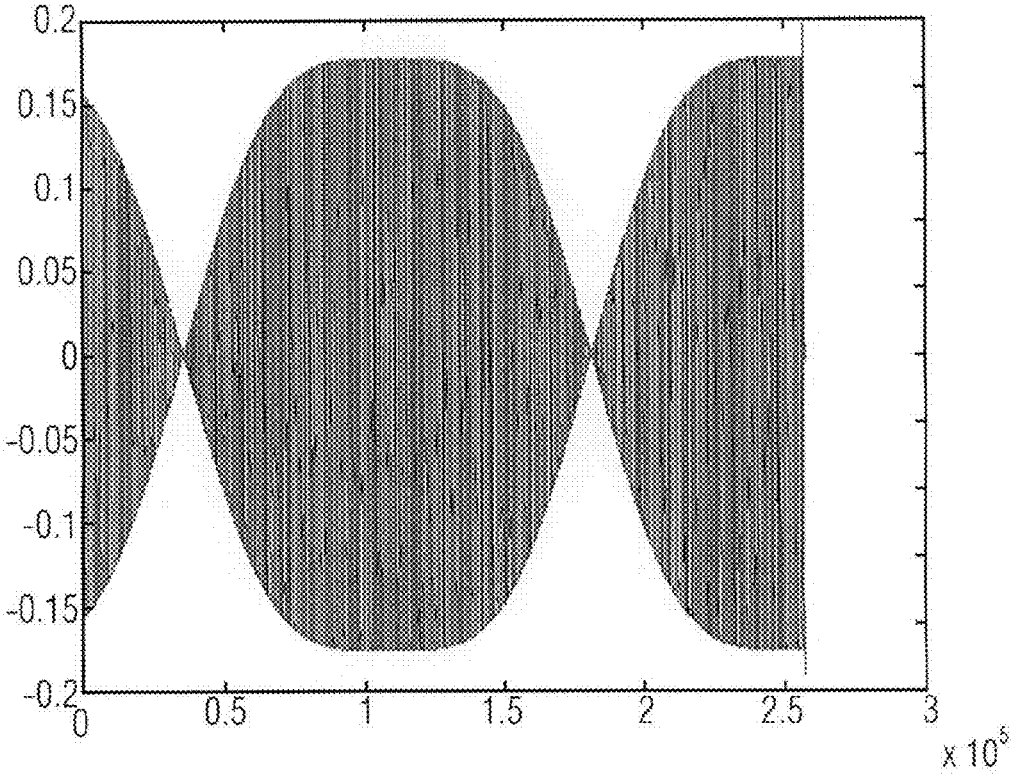
FIG. 5 illustrates a time diagram of the transposition of a slow sine sweep with poorly adjusted phase.
Figure 6:
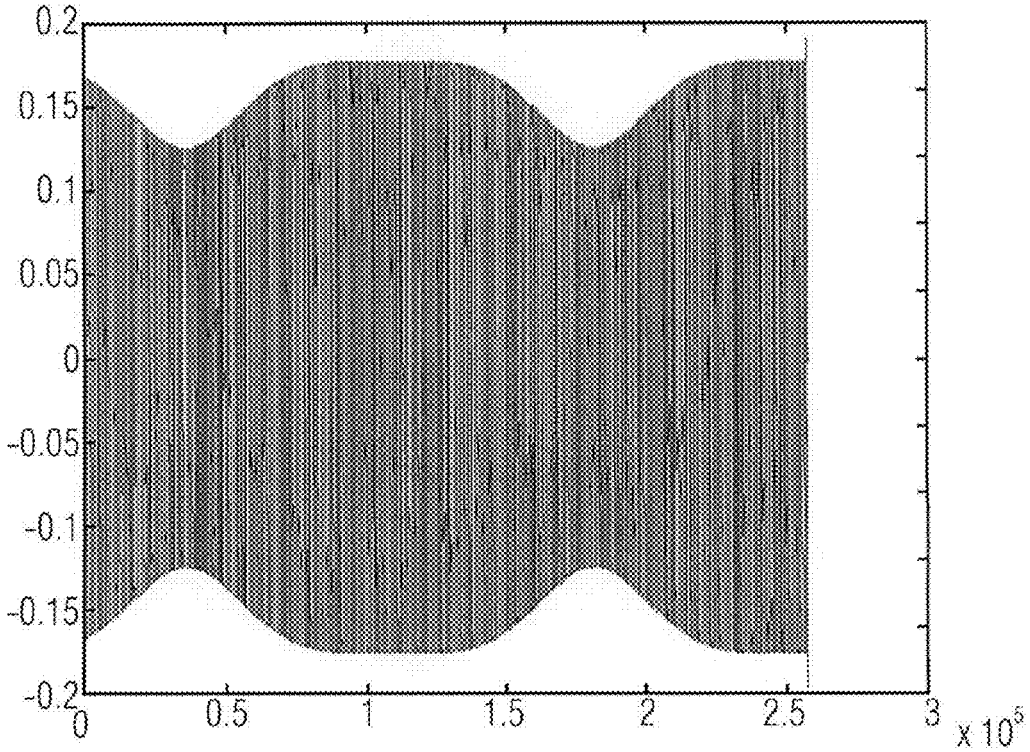
FIG. 6 illustrates a transposition of a slow sine sweep with better phase correction.

The result of a poorly adjusted phase vocoder in terms of magnitude response is illustrated by the output signal on FIG. 5 which corresponds to a sine sweep input of constant amplitude. As it can be seen, there are strong amplitude variations and even cancellations in the output. The output from a slightly better adjusted phase vocoder is depicted on FIG. 6.

An operation in a complex modulated filterbank based phase vocoder is the multiplicative phase modification of subband samples. An input time domain sinusoid results to very good precision in the complex valued subband signals of the form $$C\hat{v}_n(\omega)\exp[i(\omega q_A k+\Theta_n)]$$

where $\omega$ is the frequency of the sinusoid, n is the subband index, k is the subband time slot index, $q_A$ is the time stride of the analysis filterbank, C is a complex constant, $\hat{v}_n(\omega)$ is the frequency response of the filter bank prototype filter, and $\theta_n$ is a phase term characteristic for the filterbank in question, defined by the requirement that $\hat{v}_n(\omega)$ becomes real valued. For typical QMF filterbank designs, it can be assumed to be positive. Upon phase modification a typical result is then of the form $$D\hat{v}_n(\omega)\exp[i(T\omega q_S k+T\theta_n)]$$

where T is the transposition order and $q_S$ is the time stride of the analysis filterbank. As the synthesis filterbank is typically chosen to be a mirror image of the analysis filterbank, a proper sinusoidal synthesis necessitates this last expression to correspond to the analysis subbands of a sinusoid. The failure of conformance to this will lead to the amplitude modulations as depicted in FIG. 5.

An embodiment of the present invention is to use an additive post modification phase correction based on $$\Delta\theta_n=(1-T)\theta_n$$

This will map the unmodified subband signals into having the desirable cross subband phase evolution.

$$D\hat{v}_n(\omega)\exp[i(T\omega q_S k+T\theta_n)]\rightarrow D\hat{v}_n(\omega)\exp[i(T\omega q_S k+\theta_n)].$$

For the specific example of an oddly stacked complex modulated QMF filterbank, one has $$\theta_n=-\frac{\pi}{2}\left(n+\frac{1}{2}\right),$$

And the inventive phase correction is given based on $$\Delta\theta_n=\frac{\pi}{2}(T-1)\left(n+\frac{1}{2}\right)$$

Figure 7:
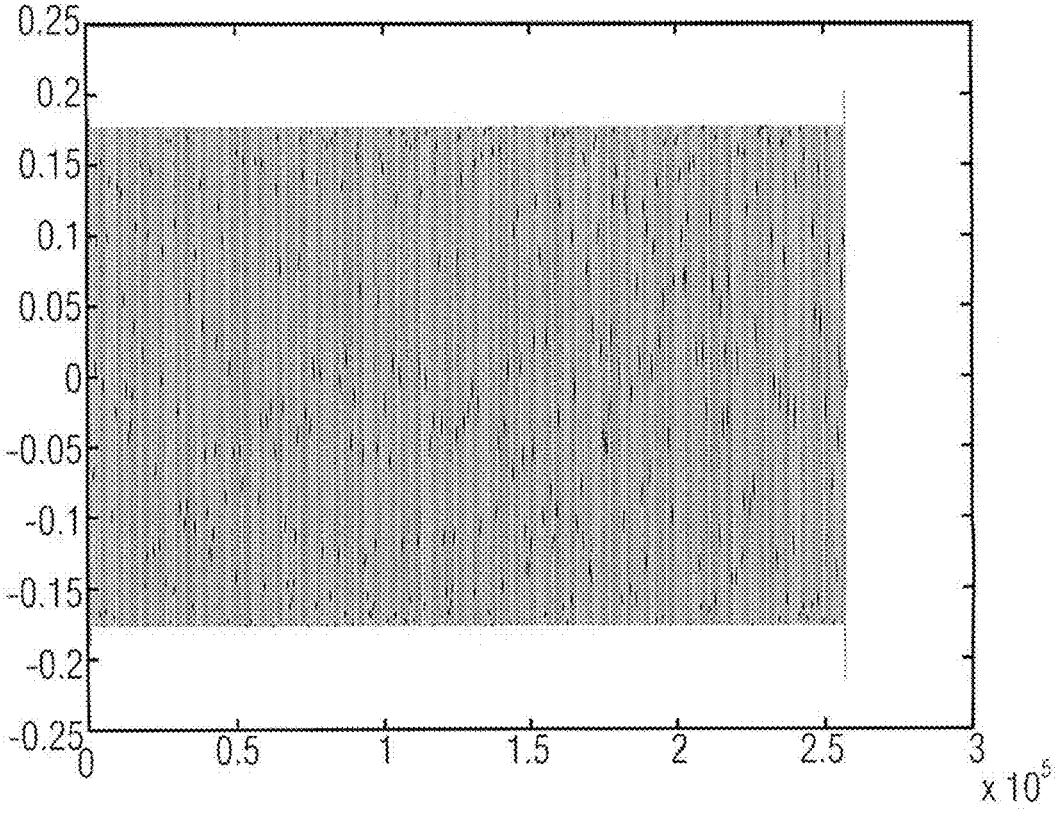
FIG. 7 illustrates a transposition of a slow sine sweep with a further improved phase correction.

The output of the phase adjusted phase vocoder according to this rule is depicted on FIG. 7.

If the analysis/synthesis filterbank pair has more asymmetric distribution of phase twiddles, there will exist a phase correction $\psi_n$ which, when added to the analysis subbands, and a minus sign prior to synthesis brings the situation back to the above symmetric case. In that case the above inventive phase correction should be adjusted based on $$\Delta\theta_n=(1-T)(\theta_n-\psi_n)$$

An example of this is given by a 64 band QMF filterbank pair used in the upcoming MPEG standard on Unified Speech and Audio coding (USAC) based on $$\Psi_n=C\pi\left(n+\frac{1}{2}\right),$$

wherein C is a real number and can have values between 2 and 3.5. Particular values are 321/128 or 385/128.

Hence for that pair one can use $$\Delta\theta_n=\frac{385}{128}\pi(T-1)\left(n+\frac{1}{2}\right).$$

Furthermore, in a special implementation of the above situation, one observes that a phase correction, which is independent the transposition order T, could be incorporated in the analysis filter bank step itself. Since a correction prior to the vocoder phase multiplication corresponds to T times the same correction after phase multiplication, the following decomposition occurs as advantageous, $$\Delta\theta_n=T\frac{385}{128}\pi\left(n+\frac{1}{2}\right)-\frac{385}{128}\pi\left(n+\frac{1}{2}\right),$$

The analysis filterbank modulation is then modified to add the phase $$\frac{385}{128}\pi\left(n+\frac{1}{2}\right)$$

compared to the case for the standardized QMF filterbank pair, and the inventive phase correction becomes equal to the second term alone, $$\Delta\theta_n=-\frac{385}{128}\pi\left(n+\frac{1}{2}\right).$$

The advantage of the phase correction is that a flat magnitude response of each vocoder order contribution to the output is obtained.

The inventive processing is suitable for all audio applications that extend the bandwidth of audio signals by application of phase vocoder time stretching and down sampling or playback at increased rate respectively.

Figure 8:
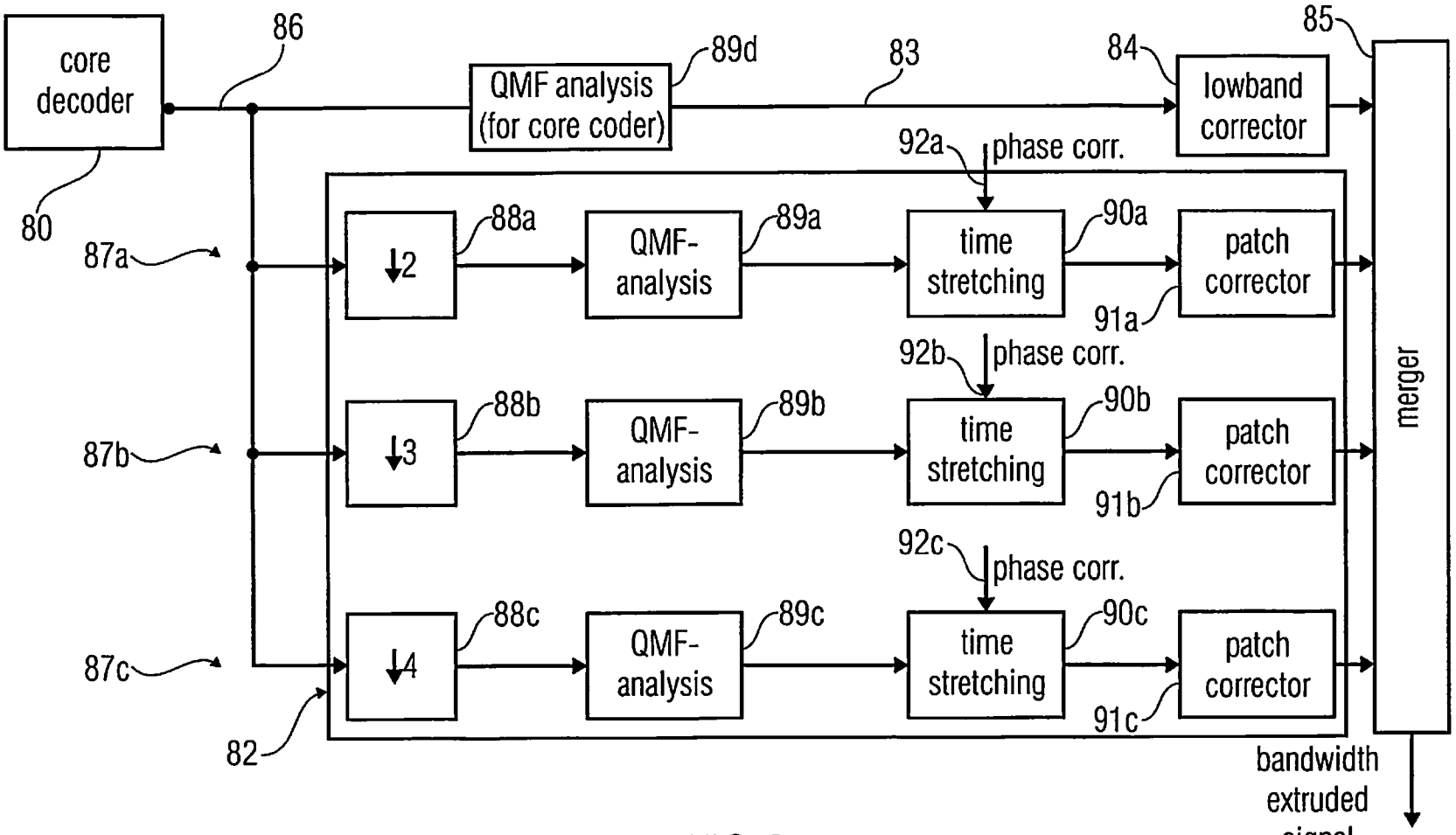
FIG. 8 illustrates a bandwidth extension system in accordance with an embodiment.

FIG. 8 illustrates a bandwidth extension system in accordance with one aspect of the present invention. The bandwidth extension system comprises a core decoder 80 generating a core decoded signal. The core decoder 80 is connected to a patch generator 82 which will be subsequently discussed in more detail. The patch generator 82 comprises all features in FIG. 8 but the core decoder 80, the low band connection 83 and the low band corrector 84 as well as the merger 85. Specifically, the patch generator is configured for generating one or more patch signals from the input audio signal 86, wherein a patch signal has a patch center frequency which is different from a patch center frequency of a different patch or from a center frequency of the input audio signal. Specifically, the patch generator comprises a first patcher 87*a*, a second patcher 87*b* and a third patcher 87*c*, where, in the FIG. 8 embodiment, each individual patcher 87*a*, 87*b*, 87*c* comprises a downsampler 88*a*, 88*b*, 88*c*, a QMF analysis block 89*a*, 89*b*, 89*c*, a time stretching block 90*a*, 90*b*, 90*c*, and a patch channel corrector block 91*a*, 91*b*, 91*c*. The outputs from blocks 91*a* to 91*c* and the low band corrector 84 are input into a merger 85 which outputs a bandwidth extended signal. This signal can be processed by further processing modules such as an envelope correction module, a tonality correction module or any other modules known from bandwidth extension signal processing.

Preferably, a patch correction is performed in such a way that the patch generator 82 generates the one or more patch signals so that a time disalignment between the input audio signal and the one or more patch signals or a time disalignment between different patch signals is, when compared to a processing without correction, reduced or eliminated. In the embodiment in FIG. 8, this reduction or elimination of the time disalignment is obtained by the patch correctors 91*a* to 91*c*. Alternatively or additionally, the patch generator 82 is configured for performing a filterbank-channel dependent phase correction with a time stretching functionality. This is indicated by the phase correction input 92*a*, 92*b*, 92*c*.

It is to be noted that the FIG. 8 embodiment is meant in such a way that each QMF analysis block such as QMF analysis block 89*a* outputs a plurality of subband signals. The time stretching functionality has to be performed for each individual subband signal. When, for example, the QMF analysis 89*a* outputs 32 subband signals, then there may exist 32 time stretchers 90*a*. However, a single patch corrector for all individually time-stretched signals of this patcher 87*a* is sufficient. As will be discussed later on, FIG. 9 illustrates the processing in the time stretcher to be performed for each individual subband signal output by a QMF analysis bank such as the QMF analysis banks 89*a*, 89*b*, 89*c*.

While a single delay for the result of all time stretched signals processed using the same time stretching amount is sufficient, an individual phase correction will have to be applied for each subband signal, since the individual phase correction is, although signal-independent, dependent on the channel number of a subband filterbank or, stated differently, a subband index of a subband signal, where a subband index means the same as a channel number in the context of this description.

Figure 9:
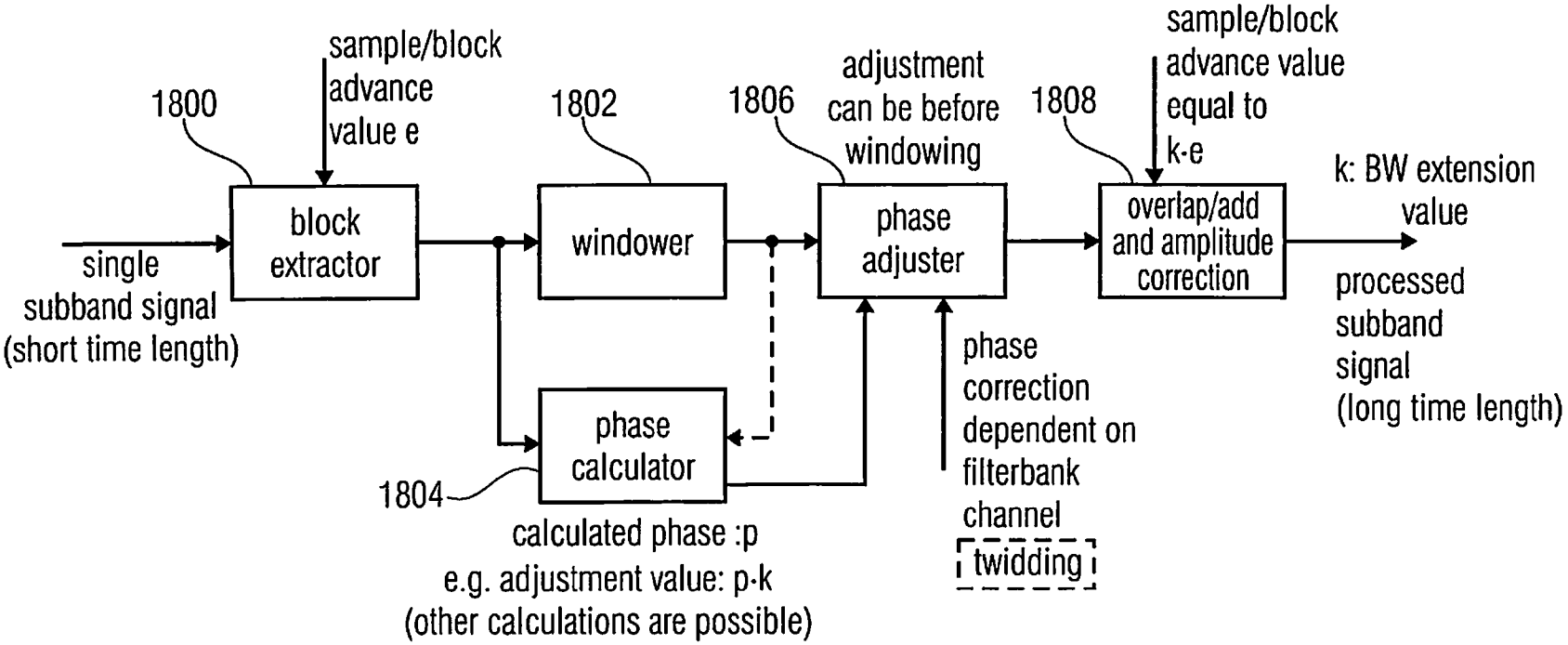
FIG. 9 illustrates another embodiment of an exemplary processing implementation for processing a single subband signal.

FIG. 9 illustrates another embodiment of an exemplary processing implementation for processing a single subband signal. The single subband signal has been subjected to any kind of decimation either before or after being filtered by an analysis filter bank not shown in FIG. 9. Therefore, the time length of the single subband signal is shorter than the time length before forming the decimation. The single subband signal is input into a block extractor 1800, which can be identical to the block extractor 201, but which can also be implemented in a different way. The block extractor 1800 in FIG. 9 operates using a sample/block advance value exemplarily called e. The sample/block advance value can be variable or can be fixedly set and is illustrated in FIG. 9 as an arrow into block extractor box 1800. At the output of the block extractor 1800, there exists a plurality of extracted blocks. These blocks are highly overlapping, since the sample/block advance value e is significantly smaller than the block length of the block extractor. An example is that the block extractor extracts blocks of 12 samples. The first block comprises samples 0 to 11, the second block comprises samples 1 to 12, the third block comprises samples 2 to 13, and so on. In this embodiment, the sample/block advance value e is equal to 1, and there is a 11-fold overlapping.

The individual blocks are input into a windower 1802 for windowing the blocks using a window function for each block. Additionally, a phase calculator 1804 is provided, which calculates a phase for each block. The phase calculator 1804 can either use the individual block before windowing or subsequent to windowing. Then, a phase adjustment value p×k is calculated and input into a phase adjuster 1806. The phase adjuster applies the adjustment value to each sample in the block. Furthermore, the factor k is equal to the bandwidth extension factor. When, for example, the bandwidth extension by a factor 2 is to be obtained, then the phase p calculated for a block extracted by the block extractor 1800 is multiplied by the factor 2 and the adjustment value applied to each sample of the block in the phase adjustor 1806 is p multiplied by 2.

In an embodiment, the single subband signal is a complex subband signal, and the phase of a block can be calculated by a plurality of different ways. One way is to take the sample in the middle or around the middle of the block and to calculate the phase of this complex sample.

Although illustrated in FIG. 9 in the way that a phase adjustor operates subsequent to the windower, these two blocks can also be interchanged, so that the phase adjustment is performed to the blocks extracted by the block extractor and a subsequent windowing operation is performed. Since both operations, i.e., windowing and phase adjustment are real-valued or complex-valued multiplications, these two operations can be summarized into a single operation using a complex multiplication factor, which, itself, is the product of a phase adjustment multiplication factor and a windowing factor.

The phase-adjusted blocks are input into an overlap/add and amplitude correction block 1808, where the windowed and phase-adjusted blocks are overlap-added. Importantly, however, the sample/block advance value in block 1808 is different from the value used in the block extractor 1800. Particularly, the sample/block advance value in block 1808 is greater than the value e used in block 1800, so that a time stretching of the signal output by block 1808 is obtained. Thus, the processed subband signal output by block 1808 has a length which is longer than the subband signal input into block 1800. When the bandwidth extension of two is to be obtained, then the sample/block advance value is used, which is two times the corresponding value in blocks 1800. This results in a time stretching by a factor of two. When, however, other time stretching factors are necessitated, then other sample/block advance values can be used so that the output of block 1808 has a necessitated time length. In an embodiment, only one sample with index m=0 will be modified to have k (or T) times it's phase. This is, in this embodiment, not valid for the whole block. For the other samples, the modification can be different as for example illustrated in FIG. 13 at block 143.

For addressing the overlap issue, an amplitude correction is performed in order to address the issue of different overlaps in block 1800 and 1808. This amplitude correction could, however, be also introduced into the windower/phase adjustor multiplication factor, but the amplitude correction can also be performed subsequent to the overlap/processing.

In the above example with a block length of 12 and a sample/block advance value in the block extractor of one, the sample/block advance value for the overlap/add block 1808 would be equal to two, when a bandwidth extension by a factor of two is performed. This would still result in an overlap of five blocks. When a bandwidth extension by a factor of three is to be performed, then the sample/block advance value used by block 1808 would be equal to three, and the overlap would drop to an overlap of three. When a four-fold bandwidth extension is to be performed, then the overlap/add block 1808 would have to use a sample/block advance value of four, which would still result in an overlap of more than two blocks.

Additionally, a phase correction dependent on the filterbank channel is input into the phase adjuster. Preferably, a single phase correction operation is performed, where the phase correction value is a combination of the signal-dependent adjustment phase value as determined by the phase calculator and the signal-independent (but filterbank channel number dependent) phase correction.

Figure 10:
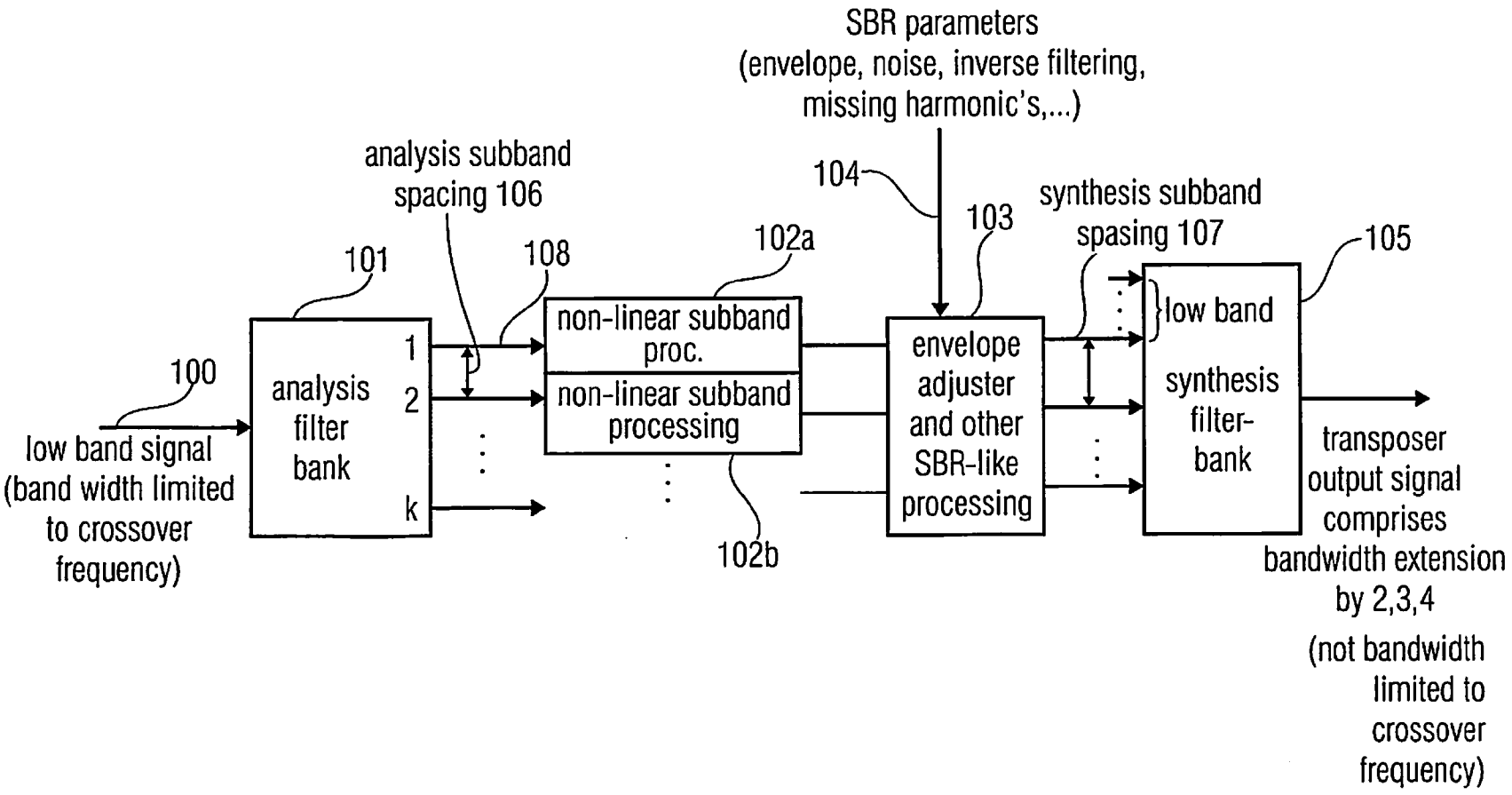
FIG. 10 illustrates an embodiment where the non-linear subband processing and a subsequent envelope adjustment within a subband domain is shown.
Figure 11A:
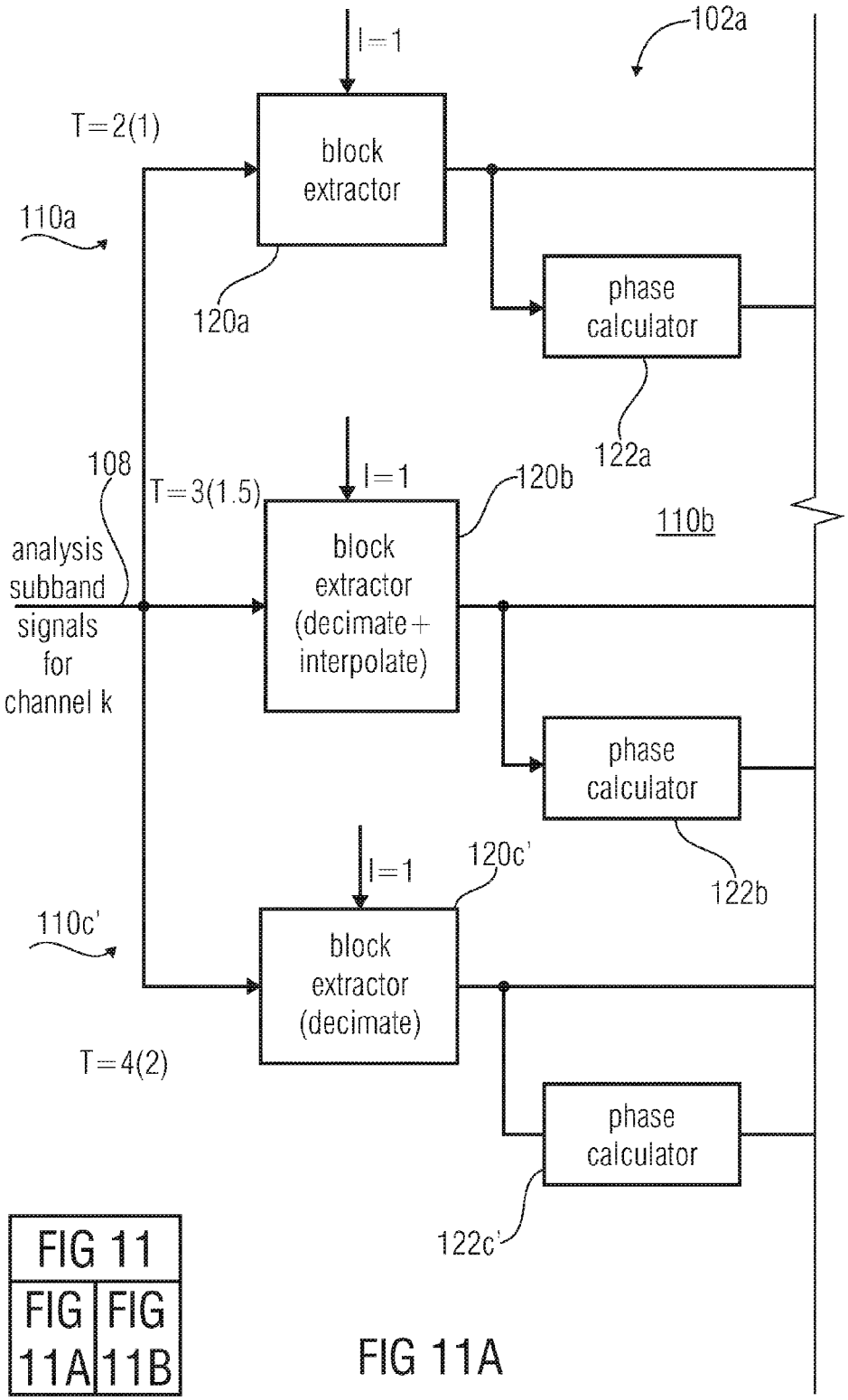
FIG. 11 illustrates a further embodiment of the non-linear subband processing of FIG. 10.
Figure 11B:
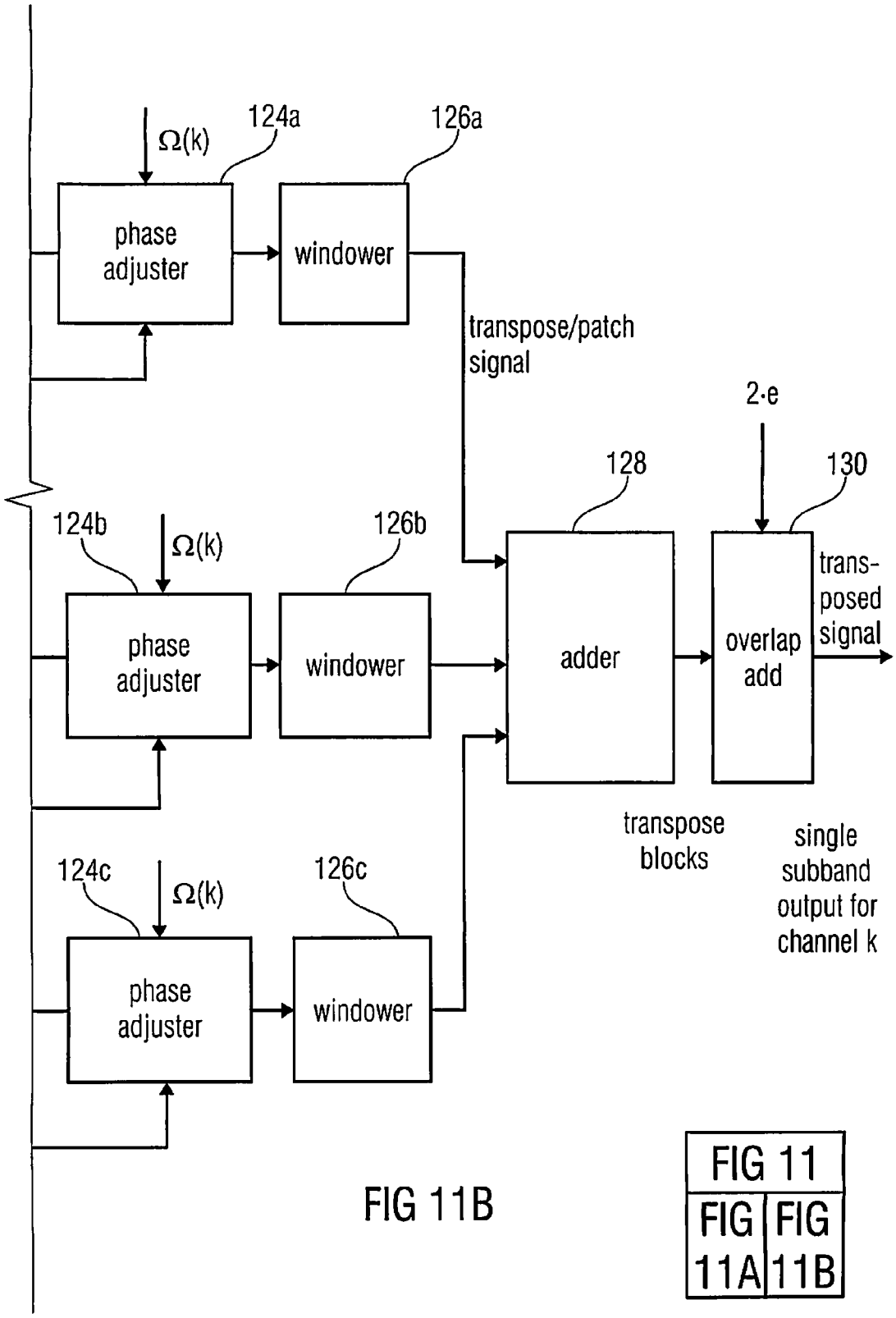

While FIG. 8 illustrates an embodiment of a bandwidth extension of an apparatus for generating a bandwidth extended audio signal having a higher bandwidth than the original core decoder signal, where several QMF analysis filterbanks 89*a* to 89*c* are used, a further embodiment, wherein only a single analysis filterbank is used is described with respect to FIGS. 10 and 11. Furthermore, it is to be outlined with respect to FIG. 8 that the QMF analysis 89*d* for the core coder is only necessitated when the merger 85 comprises a synthesis filterbank. However, when the merging with the lowband signal takes place in the time domain, then item 89*d* is not necessitated.

Furthermore, the merger 85 may additionally comprise an envelope adjuster, or basically a high frequency reconstruction processor for processing the signal input into the high frequency reconstructor based on the transmitted high frequency reconstruction parameters. These reconstruction parameters may comprise envelope adjustment parameters, noise addition parameters, inverse filtering parameters, missing harmonics parameters or other parameters. The usage of these parameters and the parameters themselves and how they are applied for performing an envelope adjustment or, generally, a generation of the bandwidth extended signal is described in ISO/IEC 14496-3: 2005(E), section 4.6.8 dedicated to the spectral band replication (SBR) tool.

Alternatively, however, the merger 85 can comprise a synthesis filterbank and subsequently to the synthesis filterbank an HFR processor for processing the signal using the HFR parameters in the time domain rather than in the filterbank domain, where the HFR processor is situated before the synthesis filterbank.

Furthermore, when FIG. 8 is considered the decimation functionality can also be applied subsequent to the QMF analysis. At the same time, the time stretching functionality illustrated at 92*a* to 92*c*, which is illustrated individually for each transposition branch, can also be performed with in a single operation for all three branches altogether.

FIG. 10 illustrates an apparatus for generating a bandwidth extended audio signal from a lowband input signal 100 in accordance with a further embodiment. The apparatus comprises an analysis filterbank 101, a subband-wise non-linear subband processor 102*a*, 102*b*, a subsequently connected envelope adjuster 103 or, generally stated, a high frequency reconstruction processor operating on high frequency reconstruction parameters as, for example, input at parameter line 104. The non-linear subband processors 102*a*, 102*b* of FIG. 10 or 11 are patch generators similar to block 82 in FIG. 8. The envelope adjuster, or as generally stated, the high frequency reconstruction processor processes individual subband signals for each subband channel and inputs the processed subband signals for each subband channel into a synthesis filterbank 105. The synthesis filterbank 105 receives, at its lower channel input signals, a subband representation of the lowband core decoder signal as generated, for example, by the QMF analysis bank 89*d* illustrated in FIG. 8. Depending on the implementation, the lowband can also be derived from the outputs of the analysis filterbank 101 in FIG. 10. The transposed subband signals are fed into higher filterbank channels of the synthesis filterbank for performing high frequency reconstruction.

The filterbank 105 finally outputs a transposer output signal which comprises bandwidth extensions by transposition factors 2, 3, and 4, and the signal output by block 105 is no longer bandwidth-limited to the crossover frequency, i.e. to the highest frequency of the core coder signal corresponding to the lowest frequency of the SBR or HFR generated signal components.

In the FIG. 10 embodiment, the analysis filterbank performs a two times over sampling and has a certain analysis subband spacing 106. The synthesis filterbank 105 has a synthesis subband spacing 107 which is, in this embodiment, double the size of the analysis subband spacing which results in a transposition contribution as will be discussed later in the context of FIG. 11.

FIG. 11 illustrates a detailed implementation of an embodiment of a non-linear subband processor 102*a* in FIG. 10. The circuit illustrated in FIG. 11 receives as an input a single subband signal 108, which is processed in three "branches": The upper branch 110*a* is for a transposition by a transposition factor of 2. The branch in the middle of FIG. 11 indicated at 110*b* is for a transposition by a transposition factor of 3, and the lower branch in FIG. 11 is for a transposition by a transposition factor of 4 and is indicated by reference numeral 110*c*. However, the actual transposition obtained by each processing element in FIG. 11 is only 1 (i.e. no transposition) for branch 110*a*. The actual transposition obtained by the processing element illustrated in FIG. 11 for the medium branch 110*b* is equal to 1.5 and the actual transposition for the lower branch 110*c* is equal to 2. This is indicated by the numbers in brackets to the left of FIG. 11, where transposition factors T are indicated. The transpositions of 1.5 and 2 represent a first transposition contribution obtained by having a decimation operations in branches 110*b*, 110*c* and a time stretching by the overlap-add processor. The second contribution, i.e. the doubling of the transposition, is obtained by the synthesis filterbank 105, which has a synthesis subband spacing 107 that is two times the analysis filterbank subband spacing. Therefore, since the synthesis filterbank has two times the synthesis subband spacing, any decimations functionality does not take place in branch 110*a*.

Branch 110*b*, however, has a decimation functionality in order to obtain a transposition by 1.5. Due to the fact that the synthesis filterbank has two times the physical subband spacing of the analysis filterbank, a transposition factor of 3 is obtained as indicated in FIG. 11 to the left of the block extractor for the second branch 110*b*.

Analogously, the third branch has a decimation functionality corresponding to a transposition factor of 2, and the final contribution of the different subband spacing in the analysis filterbank and the synthesis filterbank finally corresponds to a transposition factor of 4 of the third branch 110*c*.

Particularly, each branch has a block extractor 120*a*, 120*b*, 120*c* and each of these block extractors can be similar to the block extractor 1800 of FIG. 9. Furthermore, each branch has a phase calculator 122*a*, 122*b* and 122*c*, and the phase calculator can be similar to phase calculator 1804 of FIG. 9. Furthermore, each branch has a phase adjuster 124*a*, 124*b*, 124*c* and the phase adjuster can be similar to the phase adjuster 1806 of FIG. 9. Furthermore, each branch has a windower 126*a*, 126*b*, 126*c*, where each of these windowers can be similar to the windower 1802 of FIG. 9. Nevertheless, the windowers 126*a*, 126*b*, 126*c* can also be configured to apply a rectangular window together with some "zero padding". The transpose or patch signals from each branch 110*a*, 110*b*, 110*c*, in the embodiment of FIG. 11, is input into the adder 128, which adds the contribution from each branch to the current subband signal to finally obtain so-called transpose blocks at the output of adder 128. Then, an overlap-add procedure in the overlap-adder 130 is performed, and the overlap-adder 130 can be similar to the overlap/add block 1808 of FIG. 9. The overlap-adder applies an overlap-add advance value of 2·e, where e is the overlap-advance value or "stride value" of the block extractors 120*a*, 120*b*, 120*c*, and the overlap-adder 130 outputs the transposed signal which is, in the embodiment of FIG. 11, a single subband output for channel k, i.e. for the currently observed subband channel. The processing illustrated in FIG. 11 is performed for each analysis subband or for a certain group of analysis subbands and, as illustrated in FIG. 10, transposed subband signals are input into the synthesis filterbank 105 after being processed by block 103 to finally obtain the transposer output signal illustrated in FIG. 10 at the output of block 105.

In an embodiment, the block extractor 120*a* of the first transposer branch 110*a* extracts 10 subband samples and subsequently a conversion of these 10 QMF samples to polar coordinates is performed. The output is then defined as discussed in FIG. 13, block 143, as will be discussed later on. This output, generated by the phase adjuster 124*a*, is then forwarded to the windower 126*a*, which extends the output by zeroes for the first and the last value of the block, where this operation is equivalent to a (synthesis) windowing with a rectangular window of length 10. The block extractor 120*a* in branch 110*a* does not perform a decimation. Therefore, the samples extracted by the block extractor are mapped into an extracted block in the same sample spacing as they were extracted.

However, this is different for branches 110*b* and 110*c*. The block extractor 120*b* extracts a block of 8 subband samples and distributes these 8 subband samples in the extracted block in a different subband sample spacing. The non-integer subband sample entries for the extracted block are obtained by an interpolation, and the thus obtained QMF samples together with the interpolated samples are converted to polar coordinates and are processed by the phase adjuster 124*b* in order to result in a similar expression as the expression in block 143 of FIG. 13. Then, again, windowing in the windower 126*b* is performed in order to extend the block output by the phase adjuster 124*b* by zeroes for the first two samples and the last two samples, which operation is equivalent to a (synthesis) windowing with a rectangular window of length 8.

The block extractor 120*c* is configured for extracting a block with a time extent of 6 subband samples and performs a decimation of a decimation factor 2, performs a conversion of the QMF samples into polar coordinates and again performs an operation in the phase adjuster 124*b* in order to obtain an expression similar to what is included in block 143 of FIG. 13, and the output is again extended by zeroes, however now for the first three subband samples and for the last three subband samples. This operation is equivalent to a (synthesis) windowing with a rectangular window of length 6.

The transposition outputs of each branch are then added to form the combined QMF output by the adder 128, and the combined QMF outputs are finally superimposed using overlap-add in block 130, where the overlap-add advance or stride value is two times the stride value of the block extractors 120*a*, 120*b*, 120*c* as discussed before.

Subsequently, different embodiments for determining phase corrections are discussed in the context of FIG. 12. In an embodiment indicated at 151, a symmetric situation of an analysis/synthesis filterbank pair exists, and the phase correction $\Delta\theta_n$ has a first term 151*a* depending on the transposition factor T and a second term 151*b* which depends on the channel number n or, in the notation in FIG. 11, k.

In this embodiment, the phase adjuster is configured for applying a phase correction using the value $\Delta\theta_n$ which is indicated as $\Omega(k)$ in FIG. 11, which not only depends on the filterbank channel in accordance with term 151*b*, but which may also depend on the transposition factor T as indicated by term 151*a*. Importantly however, the phase correction does not depend on the actual subband signal. This dependency is accounted for by the phase calculator for the vocoder transposition as discussed in context with blocks 122*a*, 122*b*, 122*b*, but the phase correction or "complex output gain value $\Omega(k)$" is subband signal independent.

In a further embodiment, indicated at 152 in FIG. 12, an asymmetric distribution of phase twiddles occurs. Phase twiddles are used to shift a block of analysis filterbank input samples along the time axis and to shift output values of a synthesis filter bank along the time axis as well. The phase twiddle values are indicated by $\psi_n$. The actually used phase correction in a case with asymmetric distribution of phase twiddles is indicated for $\Delta\theta_n$, and again a transposition factor dependent term 152*a* and a subband channel dependent term 152*b* exists.

A further embodiment of the present invention indicated at 153 has the advantage over the embodiments 151 and 152 in that the phase correction term $\Delta\theta_n$ or $\Omega(k)$ illustrated in FIG. 11 only depends on the subband channel, but does not depend on the transposition factor anymore. This advantageous situation can be obtained by applying a specific application of phase twiddles to the analysis filterbank in order to cancel the transposition-dependent term of the phase correction. In a certain embodiment for a specific filterbank implementation, this value is equal to $\Delta\theta_n$ indicated in FIG. 12. However, for other filterbank designs, the value of $\Delta\theta_n$ can vary. FIG. 12 illustrates a constant factor of 385/128, but this factor can vary from 2 to 4 depending on the situation. Furthermore, it is outlined that other values apart from 385/128 can be used, and deviating from this value for the specific filterbank design, for which this value is optimum, will only result in a slight dependency on the transposition factor, which can be ignored up to a certain extent.

Figure 13:
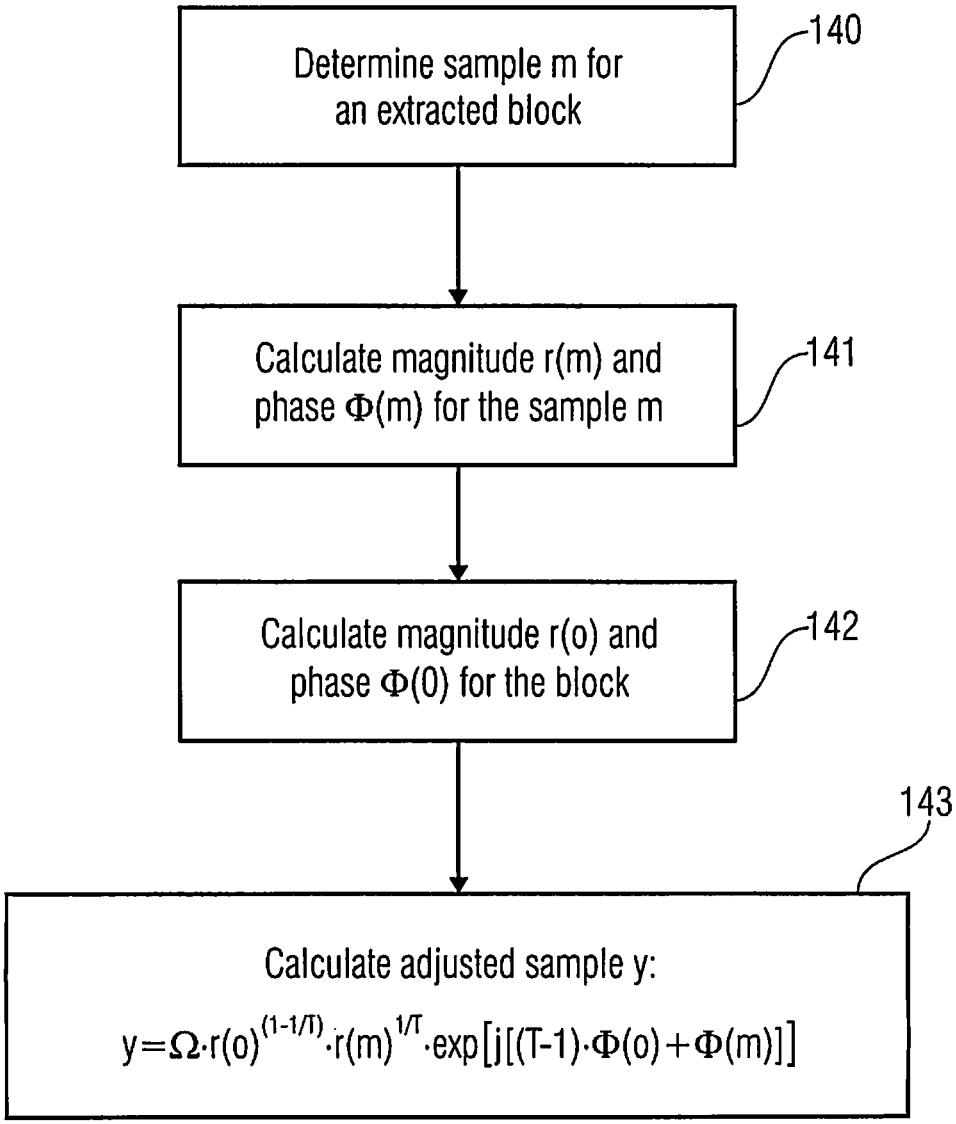
FIG. 13 illustrates an implementation of the phase adjuster.

FIG. 13 illustrates a sequence of steps performed by each transposer branch 110*a*, 110*b*, 110*c*. In a step 140, a sample m for an extracted block is determined either by a pure sample extraction as in block 120*a*, or by performing a decimation as in blocks 120*b*, 120*c* and probably also by an interpolation as indicated in the context of block 120*b*. Then, in step 141, the magnitude r and the phase $\Phi$ of each sample are calculated. In block 142, the phase calculator 122*a*, 122*b*, 122*c* in FIG. 11, calculates a certain magnitude and a certain phase for the block. In the embodiment, the magnitude and the phase of the value in the middle of the extracted and potentially decimated and interpolated block is calculated as the phase value for the block and as the amplitude value of the block. However, other samples of the block can be taken in order to determine the phase and the magnitude for each block. Alternatively, even an averaged magnitude or an averaged phase of each block that is determined by adding up the magnitudes and the phases of all samples in a block and by dividing the resulting values by the number of samples in a block can be used as the phase and the magnitude of the block. In the embodiment in FIG. 13, however, it is advantageous to use the magnitude and the phase of the sample in the middle of the block at index zero as the magnitude and the phase for the block. Then an adjusted sample is calculated by the phase adjuster 124*a*, 124*b*, 124*c* using the inventive phase correction $\Omega$ (being a complex number) as a first term, using a magnitude modification as a second term (which however can also be dispensed with), using the signal-dependent phase value calculated by blocks 122*a*, 122*b*, 122*c* corresponding to $(T-1)\cdot\Phi(0)$ as a third term, and using the actual phase of the actually considered sample $\Phi(m)$ as a fourth term as indicated in block 143.

FIG. 14*a* and FIG. 14*b* indicate two different modulation functionalities for analysis filterbanks for the embodiments in FIG. 12. FIG. 14*a* illustrates a modulation for an analysis filterbank which necessitates a phase correction that depends on the transposition factor. This modulation of the filterbank corresponds to the embodiment 153 in FIG. 12.

An alternative embodiment is illustrated in FIG. 14*b* corresponding to embodiment 152, in which a transposition factor-dependent phase correction is applied due to an asymmetric distribution of phase twiddles. Particularly, FIG. 14*b* illustrates the specific analysis filterbank modulation matching with the complex SBR filterbank in ISO/IEC 14496-3, section 4.6.18.4.2, which is incorporated herein by reference.

When FIGS. 14*a* and 14*b* are compared, it becomes clear that the amount of phase twiddling for the calculation of the cosine and sine values is different in the last two terms of FIG. 14*b* and the last term of FIG. 14*a*.

An embodiment comprises an apparatus for generating a bandwidth extended audio signal from an input signal, comprising: a patch generator for generating one or more patch signals from the input audio signal, wherein a patch signal has a patch center frequency being different from a patch center frequency of a different patch or from a center frequency of the input audio signal, wherein the patch generator is configured to generate the one or more patch signal so that a time disalignment between the input audio signal and the one or more patch signals or a time disalignment between different patch signals is reduced or eliminated, or wherein the patch generator is configured for performing a filterbank-channel dependent phase correction within a time stretching functionality.

In a further embodiment, the patch generator comprises a plurality of patchers, each patcher having a decimating functionality, a time stretching functionality, and a patch corrector for applying a time correction to the patch signals to reduce or eliminate the time disalignment.

In a further embodiment, the patch generator is configured so that the time delay is stored and selected in such a way that, when an impulse-like signal is processed, centers of gravities of patched signals obtained by the processing are aligned with each other in time.

In a further embodiment the time delays applied by the patch generator for reducing or eliminating the disalignment are fixedly stored and independent on the processed signal.

In a further embodiment the time stretcher comprises a block extractor using an extraction advance value, a windower/phase adjuster, and an overlap-adder having an overlap-add advance value being different from the extraction advance value.

In a further embodiment, a time delay applied for reducing or eliminating the disalignment depends on the extraction advance value, the overlap-add advance value or both values.

In a further embodiment, the time stretcher comprises the block extractor, the windower/phase adjuster, and the overlap-adder for at least two different channels having different channel numbers of an analysis filterbank, wherein the windower/phase adjuster for each of the at least two channels is configured for applying a phase adjustment for each channel, the phase adjustment depending on the channel number.

In a further embodiment, wherein the phase adjuster is configured for applying a phase adjustment to sampling values of a block of sampling values, the phase adjustment being a combination of a phase value depending on a time stretching amount and on an actual phase of the block, and a signal-independent phase value depending on the channel number.

Although some aspects have been described in the context of an apparatus, it is clear that these aspects also represent a description of the corresponding method, where a block or device corresponds to a method step or a feature of a method step. Analogously, aspects described in the context of a method step also represent a description of a corresponding block or item or feature of a corresponding apparatus.

The inventive encoded audio signal can be stored on a digital storage medium or can be transmitted on a transmission medium such as a wireless transmission medium or a wired transmission medium such as the Internet.

Depending on certain implementation requirements, embodiments of the invention can be implemented in hardware or in software. The implementation can be performed using a digital storage medium, for example a floppy disk, a DVD, a CD, a ROM, a PROM, an EPROM, an EEPROM or a FLASH memory, having electronically readable control signals stored thereon, which cooperate (or are capable of cooperating) with a programmable computer system such that the respective method is performed.

Some embodiments according to the invention comprise a data carrier having electronically readable control signals, which are capable of cooperating with a programmable computer system, such that one of the methods described herein is performed.

Generally, embodiments of the present invention can be implemented as a computer program product with a program code, the program code being operative for performing one of the methods when the computer program product runs on a computer. The program code may for example be stored on a machine readable carrier.

Other embodiments comprise the computer program for performing one of the methods described herein, stored on a machine readable carrier.

In other words, an embodiment of the inventive method is, therefore, a computer program having a program code for performing one of the methods described herein, when the computer program runs on a computer.

A further embodiment of the inventive methods is, therefore, a data carrier (or a digital storage medium, or a computer-readable medium) comprising, recorded thereon, the computer program for performing one of the methods described herein.

A further embodiment of the inventive method is, therefore, a data stream or a sequence of signals representing the computer program for performing one of the methods described herein. The data stream or the sequence of signals may for example be configured to be transferred via a data communication connection, for example via the Internet.

A further embodiment comprises a processing means, for example a computer, or a programmable logic device, configured to or adapted to perform one of the methods described herein.

A further embodiment comprises a computer having installed thereon the computer program for performing one of the methods described herein.

In some embodiments, a programmable logic device (for example a field programmable gate array) may be used to perform some or all of the functionalities of the methods described herein. In some embodiments, a field programmable gate array may cooperate with a microprocessor in order to perform one of the methods described herein. Generally, the methods are performed by any hardware apparatus.

While this invention has been described in terms of several advantageous embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations, and equivalents as fall within the true spirit and scope of the present invention.

LITERATURE

[1] J. L. Flanagan and R. M. Golden, Phase Vocoder, The Bell System Technical Journal, November 1966, pp 1394-1509

[2] U.S. Pat. No. 6,549,884 Laroche, J. & Dolson, M.: Phase-vocoder pitch-shifting

[3] J. Laroche and M. Dolson, New Phase-Vocoder Techniques for Pitch-Shifting, Harmonizing and Other Exotic Effects, Proc. IEEE Workshop on App. of Signal Proc. to Signal Proc. to Audio and Acous., New Paltz, N.Y. 1999.

[4] Frederik Nagel, Sascha Disch, A harmonic bandwidth extension method for audio codecs, ICASSP, Taipei, Taiwan, April 2009

[5] Frederik Nagel., Sascha Disch and Nikolaus Rettelbach, A phase vocoder driven bandwidth extension method with novel transient handling for audio codecs, 126$^{th}$ AES Convention, Munich, Germany, May 7-10, 2009

The invention claimed is:

1. An apparatus for generating a bandwidth extended audio signal from an input signal, comprising:

a patch generator for generating one or more patch signals from the input signal, wherein a patch signal comprises a patch center frequency being different from a patch center frequency of a different patch or from a center frequency of the input audio signal, wherein the patch generator is configured for performing a time stretching of subband signals from an analysis filterbank, and wherein the patch generator comprises a phase adjuster for adjusting phases of the subband signals using a filterbank-channel dependent phase correction, the filterbank-channel dependent phase correction comprising:

$$\pi C(k+1/2)$$

wherein k indicates a filterbank channel and C is a real number between 2 and 4.

2. The apparatus in accordance with claim 1, in which the phase adjuster is configured to select the phase correction so that an amplitude variation of a signal introduced by a design of the filterbank is reduced or eliminated.

3. The apparatus in accordance with claim 1, in which the phase adjuster is configured for applying the phase correction, the phase correction being independent on the subband signal.

4. The apparatus in accordance with claim 1, in which the phase adjuster is configured to additionally apply a signal-dependent phase correction depending on an applied transposition factor.

5. The apparatus in accordance with claim 1, in which the patch generator is configured for performing a block-wise processing and comprises:

a block extractor for extracting subsequent blocks of values from the subband signal using a block advance value;

the phase adjuster; and an overlap-add processor, wherein the overlap-add processor is configured for applying a block advance value being larger than the block advance value to acquire the time stretching.

6. The apparatus in accordance with claim 5, in which the block extractor is configured to additionally perform a decimation operation dependent on the transposition factor T and to perform an interpolation in case of a non-integer decimation operation.

7. The apparatus in accordance with claim 5, in which the patch generator further comprises a windower for windowing a block using a window function.

8. The apparatus in accordance with claim 1, which is configured for performing a bandwidth extension using at least two transposition factors T, wherein the patch generator is configured:

for the first transposition factor, to extract using a block advance value and using no or a first decimation using a first decimation factor;

to phase adjust the samples of the block of subband samples;

to zero pad the phase adjusted block to a certain length to acquire a first transpose signal;

for the second transposition factor, to extract a block of subband samples using a block advance value and using a decimation using a second decimation factor being greater than the first decimation factor, when a first decimation has been performed;

to phase adjust the samples of the block of subband samples; and to zero pad the phase adjusted block to a certain length to acquire a second transposed signal;

to add the first and the second transposed signal in a sample-by-sample to acquire a transpose block; and to overlap-add sequential transpose blocks using an advance value being greater than the block advance value to acquire a transposed subband signal.

9. The apparatus in accordance with claim 1, further comprising:

a high frequency reconstruction processor for applying high frequency reconstruction parameters to the subband signals subsequent to the phase correction applied to the subband signals to acquire adjusted subband signals.

10. The apparatus in accordance with claim 1, further comprising a synthesis filterbank comprising a subband spacing being greater than a subband spacing of the analysis filterbank.

11. The apparatus in accordance with claim 1, in which the patch generator comprises an analysis filterbank for generating the subband signals from a lowband signal, wherein the analysis filter bank a Quadrature Mirror Filterbank comprising phase twiddling, and in which the phase correction depends on the transposition factor.

12. The apparatus in accordance with claim 1, in which the analysis filterbank is a QMF filterbank and is configured to apply a phase twiddling so that the phase correction is independent from a transposition factor used for generating the one or more patched signals.

13. The apparatus in accordance with claim 1, in which the patch generator comprises a time stretcher, and in which the time stretcher comprises a block extractor using an extraction advance value.

14. The apparatus in accordance with claim 1, in which the patch generator comprises a time stretcher, wherein the time stretcher comprises a block extractor, a windower, or a phase adjuster and the overlap-adder for at least two different channels comprising different channel numbers of an analysis filterbank, wherein the windower or phase adjuster for each of the at least two channels is configured for applying a phase adjustment for each channel, the phase adjustment depending on the channel number.

15. The apparatus in accordance with claim 1, in which the phase adjuster is configured for applying a phase adjustment to sampling values of a block of sampling values, the phase adjustment being a combination of a phase value depending on the time stretching amount and on an actual phase of the block, and a signal-independent phase value depending on the channel number as the phase correction.

16. The apparatus in accordance with claim 1, in which the patch generator is configured to generate the one or more patch signals so that a time disalignment between the input audio signal and the one or more patch signals or a time disalignment between different patch signals is reduced or eliminated.

17. The apparatus in accordance with claim 1, in which the patch generator comprises a plurality of patches, at least one patcher comprising a decimating functionality, a time stretching functionality and a patch corrector for applying a time correction to the patch signals to reduce or eliminate the time disalignment.

18. A method of generating a bandwidth extended audio signal from an input signal, comprising:

generating one or more patch signals from the input signal, wherein a patch signal comprises a patch center frequency being different from a patch center frequency of a different patch or from a center frequency of the input audio signal, wherein a time stretching of subband signals from an analysis filterbank is performed, and wherein phases of the subband signals are adjusted using a filterbank-channel dependent phase correction, the filterbank-channel dependent phase correction comprising:

$$\pi C(k+1/2)$$

wherein k indicates a filterbank channel and C is a real number between 2 and 4.

19. A non-transitory storage medium having stored thereon a computer program comprising a program code for performing, when running in a computer, the method of generating a bandwidth extended audio signal from an input signal, the method comprising:

generating one or more patch signals from the input signal, wherein a patch signal comprises a patch center frequency being different from a patch center frequency of a different patch or from a center frequency of the input audio signal, wherein a time stretching of subband signals from an analysis filterbank is performed, and wherein phases of the subband signals are adjusted using a filterbank-channel dependent phase correction, the filterbank-channel dependent phase correction comprising:

$$\pi C(k+1/2)$$

wherein k indicates a filterbank channel and C is a real number between 2 and 4.

20. An apparatus for generating a bandwidth extended audio signal from an input signal, comprising:

a patch generator for generating one or more patch signals from the input signal, wherein a patch signal comprises a patch center frequency being different from a patch center frequency of a different patch or from a center frequency of the input audio signal, wherein the patch generator is configured for performing a time stretching of subband signals from an analysis filterbank, and wherein the patch generator comprises a phase adjuster for adjusting phases of the subband signals using a filterbank-channel dependent phase correction, wherein the apparatus is configured for performing a bandwidth extension using at least two transposition factors, wherein the patch generator is configured:

for the first transposition factor, to extract using a block advance value and to use no or a first decimation using a first decimation factor;

to phase adjust the samples of the block of subband samples;

to zero pad the phase adjusted block to a certain length to acquire a first transpose signal;

for the second transposition factor, to extract a block of subband samples using a block advance value and to use a decimation using a second decimation factor being greater than the first decimation factor;

to phase adjust the samples of the block of subband samples; and to zero pad the phase adjusted block to a certain length to acquire a second transposed signal;

to add the first and the second transposed signal in a sample-by-sample to acquire a transpose block; and to overlap-add sequential transpose blocks using an advance value being greater than the block advance value to acquire a transposed subband signal.

21. A method of generating a bandwidth extended audio signal from an input signal, comprising:

generating one or more patch signals from the input signal, wherein a patch signal comprises a patch center frequency being different from a patch center frequency of a different patch or from a center frequency of the input audio signal, wherein a time stretching of subband signals from an analysis filterbank is performed, and wherein phases of the subband signals are adjusted using a filterbank-channel dependent phase correction, wherein the method comprises performing a bandwidth extension using at least two transposition factors, wherein the generating one or more patch signals comprises:

for the first transposition factor, extracting using a block advance value and using no or a first decimation using a first decimation factor;

phase adjusting the samples of the block of subband samples;

zero padding the phase adjusted block to a certain length to acquire a first transpose signal;

for the second transposition factor, extracting a block of subband samples using a block advance value and using a decimation using a second decimation factor being greater than the first decimation factor;

phase adjusting the samples of the block of subband samples; and zero padding the phase adjusted block to a certain length to acquire a second transposed signal;

adding the first and the second transposed signal in a sample-by-sample to acquire a transpose block; and overlap-adding sequential transpose blocks using an advance value being greater than the block advance value to acquire a transposed subband signal.

22. A non-transitory storage medium having stored thereon a computer program comprising a program code for performing, when running in a computer, the method of generating a bandwidth extended audio signal from an input signal, the method comprising:

generating one or more patch signals from the input signal, wherein a patch signal comprises a patch center frequency being different from a patch center frequency of a different patch or from a center frequency of the input audio signal, wherein a time stretching of subband signals from an analysis filterbank is performed, and wherein phases of the subband signals are adjusted using a filterbank-channel dependent phase correction, wherein the method comprises performing a bandwidth extension using at least two transposition factors, wherein the generating one or more patch signals comprises:

for the first transposition factor, extracting using a block advance value and using no or a first decimation using a first decimation factor;

phase adjusting the samples of the block of subband samples;

zero padding the phase adjusted block to a certain length to acquire a first transpose signal;

for the second transposition factor, extracting a block of subband samples using a block advance value and using a decimation using a second decimation factor being greater than the first decimation factor;

phase adjusting the samples of the block of subband samples; and zero padding the phase adjusted block to a certain length to acquire a second transposed signal;

adding the first and the second transposed signal in a sample-by-sample to acquire a transpose block; and overlap-adding sequential transpose blocks using an advance value being greater than the block advance value to acquire a transposed subband signal.

23. An apparatus for generating a bandwidth extended audio signal from an input signal, comprising:

a patch generator for generating one or more patch signals from the input signal, wherein a patch signal comprises a patch center frequency being different from a patch center frequency of a different patch or from a center frequency of the input audio signal, wherein the patch generator is configured for performing a time stretching of subband signals from an analysis filterbank, wherein the patch generator comprises a phase adjuster for adjusting phases of the subband signals using a filterbank-channel dependent phase correction, and wherein the phase adjuster is configured for applying a phase adjustment to sampling values of a block of sampling values, the phase adjustment being a combination of a phase value depending on a time stretching amount and on an actual phase of the block, and a signal-independent phase value depending on the channel number as the phase correction.

24. A method of generating a bandwidth extended audio signal from an input signal, comprising:

generating one or more patch signals from the input signal, wherein a patch signal comprises a patch center frequency being different from a patch center frequency of a different patch or from a center frequency of the input audio signal, wherein a time stretching of subband signals from an analysis filterbank is performed, wherein phases of the subband signals are adjusted using a filterbank-channel dependent phase correction, and wherein a phase adjustment is applied to sampling values of a block of sampling values, the phase adjustment being a combination of a phase value depending on a time stretching amount and on an actual phase of the block, and a signal-independent phase value depending on the channel number as the phase correction.

25. A non-transitory storage medium having stored thereon a computer program comprising a program code for performing, when running in a computer, the method of generating a bandwidth extended audio signal from an input signal, the method comprising:

generating one or more patch signals from the input signal, wherein a patch signal comprises a patch center frequency being different from a patch center frequency of a different patch or from a center frequency of the input audio signal, wherein a time stretching of subband signals from an analysis filterbank is performed, wherein phases of the subband signals are adjusted using a filterbank-channel dependent phase correction, and wherein a phase adjustment is applied to sampling values of a block of sampling values, the phase adjustment being a combination of a phase value depending on a time stretching amount and on an actual phase of the block, and a signal-independent phase value depending on the channel number as the phase correction.

* * * * *